US006774759B2

(12) United States Patent
Kolody et al.

(10) Patent No.: US 6,774,759 B2
(45) Date of Patent: Aug. 10, 2004

(54) COMBINED FUSE HOLDER AND CURRENT MONITOR

(75) Inventors: Timothy Kolody, Lorain, OH (US); Richard E. Trifiletti, Lorain, OH (US); Scott C Lewis, Amherst, OH (US); Kurt P. Fattman, Westlake, OH (US)

(73) Assignee: Marconi Intellectual Property (Ringfence), Inc., Warrendale, PA (US)

( * ) Notice: Subject to any disclaimer, the term of this patent is extended or adjusted under 35 U.S.C. 154(b) by 284 days.

(21) Appl. No.: 09/861,204

(22) Filed: May 18, 2001

(65) Prior Publication Data

US 2002/0170737 A1 Nov. 21, 2002

(51) Int. Cl.[7] ..... H01H 85/02

(52) U.S. Cl. ..... 337/221; 324/126; 439/487; 439/621; 439/857

(58) Field of Search ..... 439/621, 487, 439/698, 857; 337/221; 340/638, 639; 324/117 R, 117 H, 126

(56) References Cited

U.S. PATENT DOCUMENTS 2,229,989 A * 1/1941 Roby ..... 439/830
4,743,875 A * 5/1988 Murphy ..... 335/18
4,749,940 A * 6/1988 Bullock ..... 324/127
4,952,915 A 8/1990 Jenkins et al.
5,124,567 A 6/1992 Fujita et al.
5,532,907 A 7/1996 Asselta et al.
5,617,299 A 4/1997 Knoop et al.
5,917,401 A * 6/1999 Smith ..... 324/126
6,157,287 A * 12/2000 Douglass. ..... 337/198
6,205,029 B1 3/2001 Byrne et al.

FOREIGN PATENT DOCUMENTS

GB 2259783 3/1993

OTHER PUBLICATIONS

Patent Abstracts of Japan, Publication No. 08115802, Publication Date Jul. 5, 1996; Applicant: Fuji Electric Co Ltd., Title: Four–Terminal Shunt Resistor.

* cited by examiner

*Primary Examiner*—Neil Abrams
(74) *Attorney, Agent, or Firm*—Jones Day

(57) ABSTRACT

A combined fuse holder and shunt has a shunt integrated into a one-piece assembly between a fuse holder and a circuit connector. The housing for the connectors is made in two halves that are heat staked together after the connectors are inserted therein. Slots and ribs in the housing retain the connectors therein without requiring supplemental fasteners.

13 Claims, 7 Drawing Sheets

ENGINEERING SUPPORT SERVICES

View A
Scale 4:1
Sharp Corner (3 Plc's)
Sharp Corner @ Bottom of Rib (This Side Only)
Sharp Corner @ Bottom of Pocket
Sharp Corner (16 Plc's)
ENGINEERING SUPPORT SERVICES
GENERAL TOLERANCES
MATERIAL: NATURAL - GP
NOTES:

4.500
4.257
3.492
2.632
1.867
1.007
0.875
1.844
1.750
0.242
R0.13 (2 Plc's)

68
70
62
66
60
C
0.785
0.156
1.500
3.000
4.344
C0.06 (2 Plc's)
Ø0.281 (6 Plc's)
0.570
0.250
0.160
0.500
0.250
0.864
C0.13
1.917
3.325
0.250
0.250
0.440
1.928
Ø0.380

RH-Bus-Rev07

LH-Shunt-Rev03
4.3444.500
0.444
0.156
0.500
0.050
3.800
1.750
0.875
3.875
2.250
0.625
1.540
1.240
1.928
15 X 0.125
16 x 0.250
0.56
Ø0.380
0.250
0.440
2.430
0.570
0.250
0.160
Ref.
900
3.880
2.980
0.875
0.250
0.058
0.286
2.315
1.915
0.250
0.864
R0.60 (2 Plc's)
R0.13
C0.06 (32 Plc's)
1c's)

COMBINED FUSE HOLDER AND CURRENT MONITOR

BACKGROUND OF THE INVENTION

This application relates to the art of fuse holders and, more particularly, to a combined fuse holder and shunt. The invention is particularly applicable for use in the telecommunications industry and will be described with particular reference thereto. However, it will be appreciated that the invention has broader aspects and can be used for other purposes.

It is common to measure the voltage drop across line and load terminals in telecommunications applications. This commonly is done by providing a shunt that allows measurement of the voltage drop. In prior arrangements, the shunt usually is a special device that is wired into a circuit rather than being a pre-manufactured part of a component.

It would be desirable to provide an arrangement in which the shunt is combined with a fuse holder in a convenient and efficient manner.

SUMMARY OF THE INVENTION

A combined fuse holder and shunt includes a pair of circuit connectors. A pair of fuse connectors are connected between the pair of circuit connectors, and a shunt is connected between one of the fuse connectors and one of the circuit connectors.

In a preferred arrangement, the shunt is connected between the load circuit connector and one of the fuse connectors.

In accordance with another aspect of the application, each of the circuit connectors is in one integral piece with one of the fuse connectors.

In accordance with another aspect of the application, one circuit connector and one fuse connector have a shunt soldered there between so that the circuit connector, fuse connector and shunt form a one-piece assembly.

The combined fuse holder and shunt is retained within a two-piece plastic housing. Each housing piece has an end wall with a slot therein through which the circuit connectors project.

Ribs on the housing side walls have rib ends spaced above the housing bottom wall, and opposite side portions of the combined fuse holder and shunt are received between the rib ends and the bottom wall to retain same within the housing.

A heat sink on the fuse bolder and shunt is received in a depression in the housing bottom wall. A slotted depression bottom wall provides air circulation past the heat sink.

It is a principal object of the present invention to provide a combined fuse holder and shunt.

It is another object of the invention to provide a combined fuse holder and shunt that is convenient to manufacture and assemble.

It is an additional object of the invention to provide a combined fuse holder and shunt wherein circuit connector terminals, fuse connector terminals and a shunt are integrated into a one-piece assembly.

BRIEF DESCRIPTION OF THE DRAWING

FIG. 8 is an end elevational view of the opposite end thereof;

FIG. 15 is a perspective illustration of a prior art fuse holder and fuse assembly;

DESCRIPTION OF A PREFERRED EMBODIMENT

Figures 12, 13, 14:
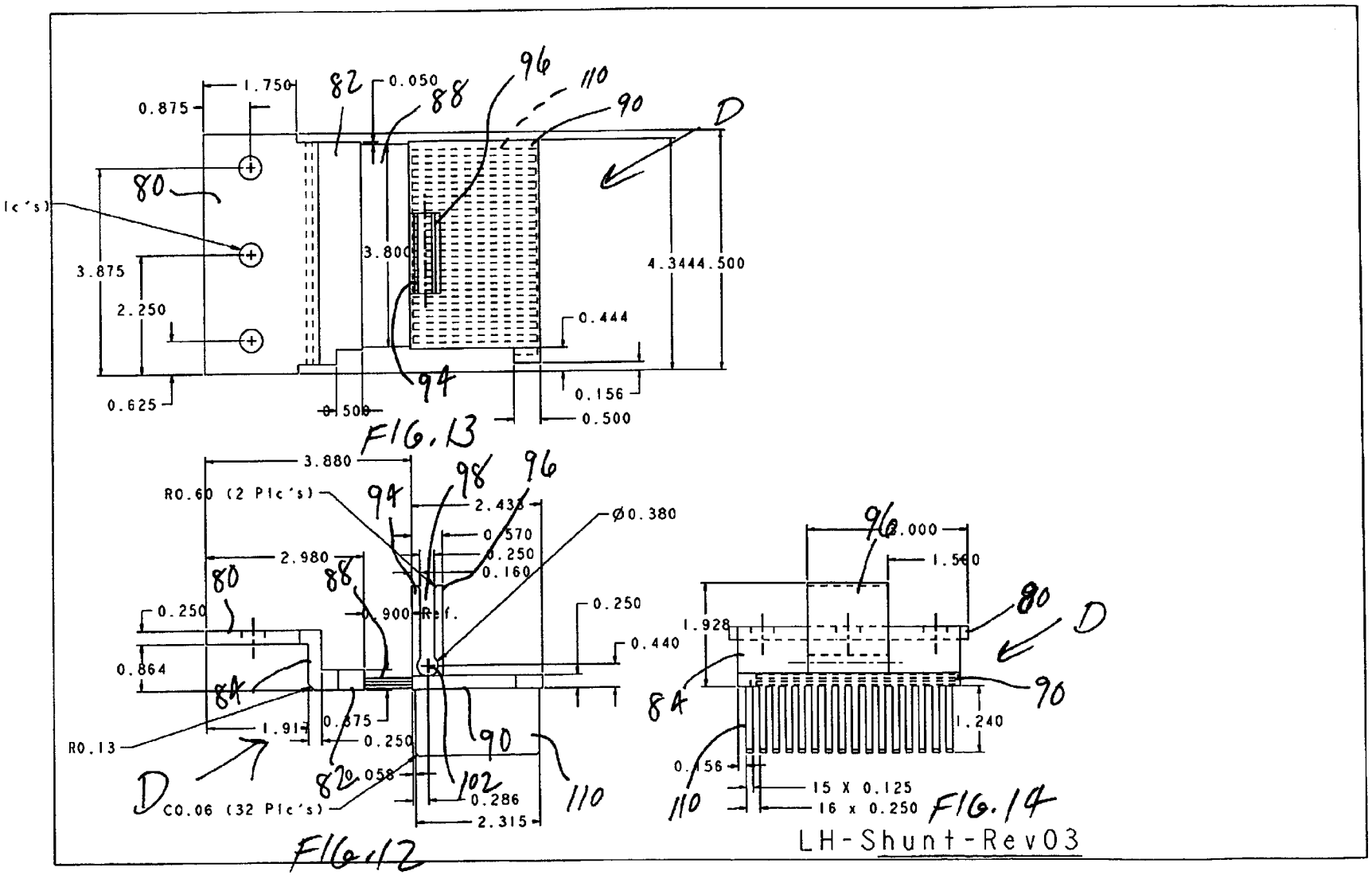
FIG. 12 is a side elevational view of a load circuit connector having a shunt positioned between the circuit connector and a fuse connector.
FIG. 13 is a top plan view thereof.
FIG. 14 is an end elevational view thereof.

Referring now to the drawing, wherein the showings are for purposes of illustrating a preferred embodiment of the invention only and not for purposes of limiting same, FIGS. 14 show a left hand half of a plastic housing A having opposite end walls 10, 12, a sidewall 14 and a partial top wall 16 with an opening 18 therein. The side of the housing half opposite from sidewall 14 is open and the periphery of the open side is generally indicated by number 19. Housing half A includes a stepped bottom wall including end bottom wall portions 20, 22 extending perpendicular to sidewall 14 and end walls 10, 12 and having a depression 24 therebetween with a depression bottom wall 26.

A sidewall of depression 24 is an integral extension of sidewall 14, and depression bottom wall 26 extends perpendicular thereto integral therewith. The opposite ends of depression 24 that face outwardly in the direction of end walls 10, 12 are completely open as generally indicated at 28, 30 to provide air circulation through the depression in a direction between end walls 10, 12.

A plurality of spaced-apart vertical ribs 36–39 are molded integrally with side wall 14 and the underside of top wall 16. The ribs have rib ends that are spaced above bottom wall portions 20, 26 to provide a space for receiving opposite side portions of a fuse holder and shunt assembly therebeneath. Horizontal slots 42, 44 extend into end walls 10, 12 from the open side of the housing above bottom wall portions 20, 22. The slots extend perpendicular to sidewall 14 and parallel to bottom wall portions 20, 22.

FIGS. 5–8 show a right hand housing half A1. Corresponding features of right housing half A1 are identified by the same reference numerals as those in FIGS. 1–4 followed by the letter a.

Figures 1, 2, 3, 4:
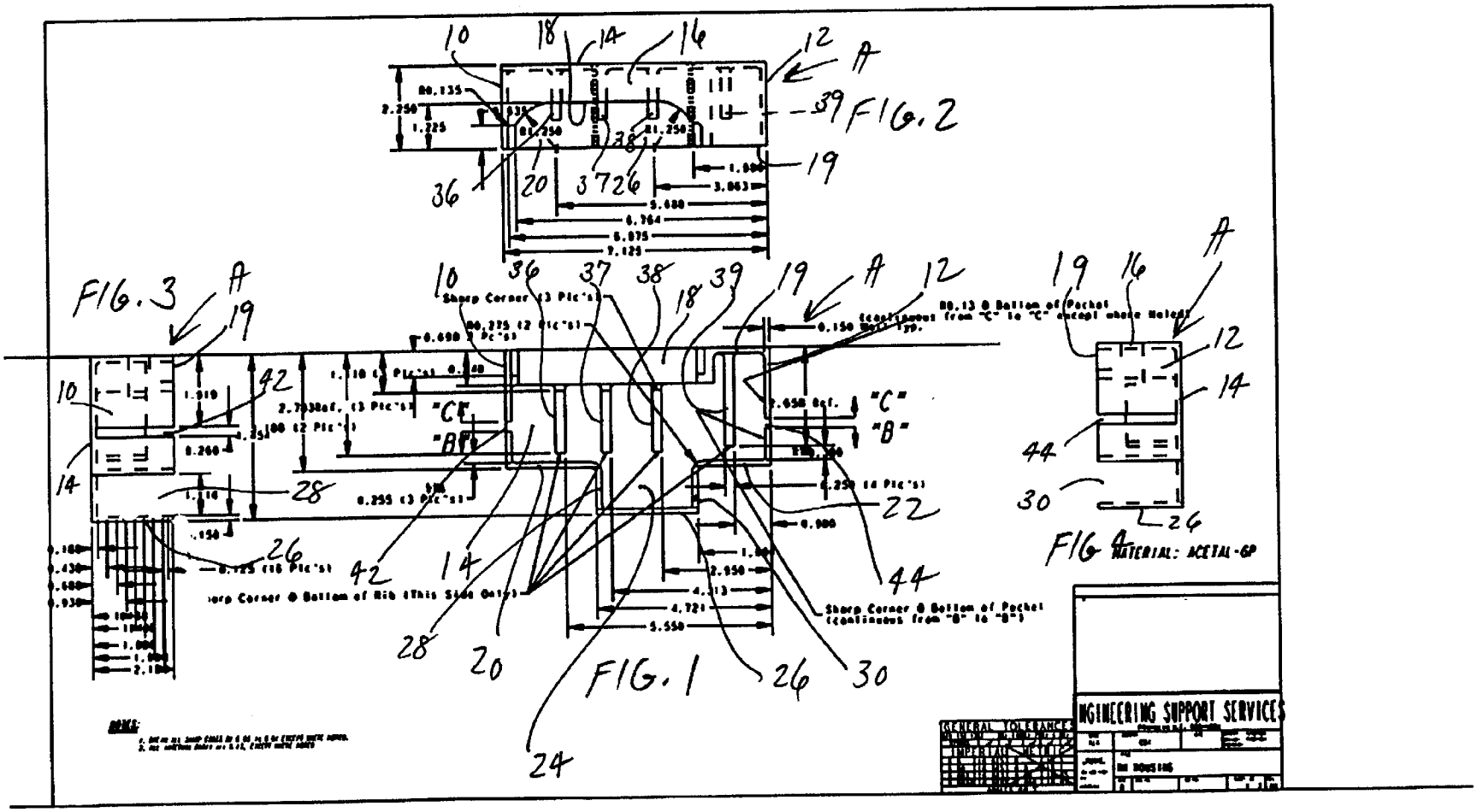
FIG. 1 is a side elevational view of one-half of a plastic housing.
FIG. 2 is a top plan view thereof.
FIG. 3 is an end elevational view of one end thereof.
FIG. 4 is an end elevational view of the opposite end thereof.
Figures 5, 6, 7:
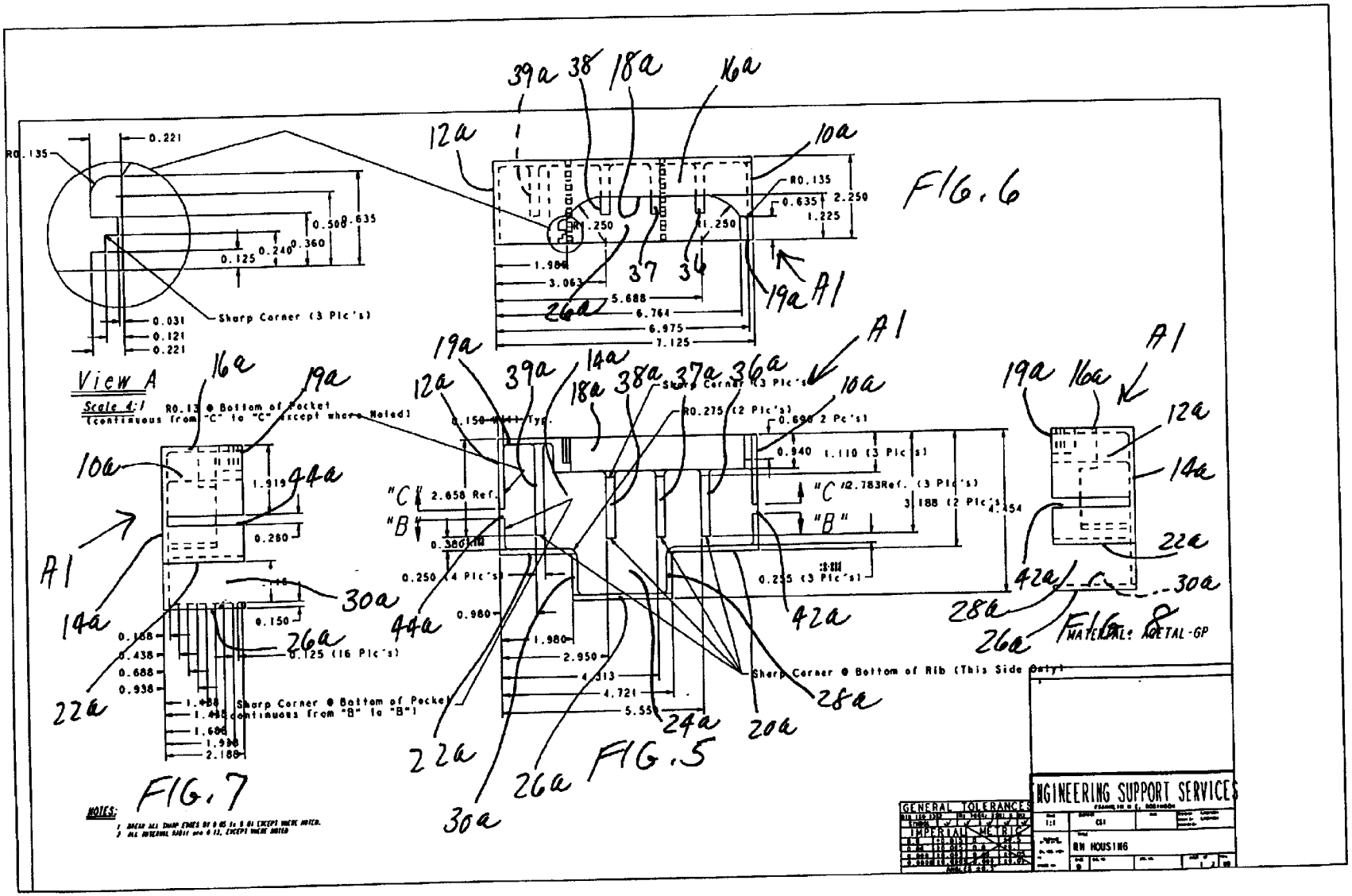
FIG. 5 is a side elevational view of another plastic housing half.
FIG. 6 is a top plan view thereof.
FIG. 7 is an end elevational view of one end thereof.
Figures 9, 10, 11:
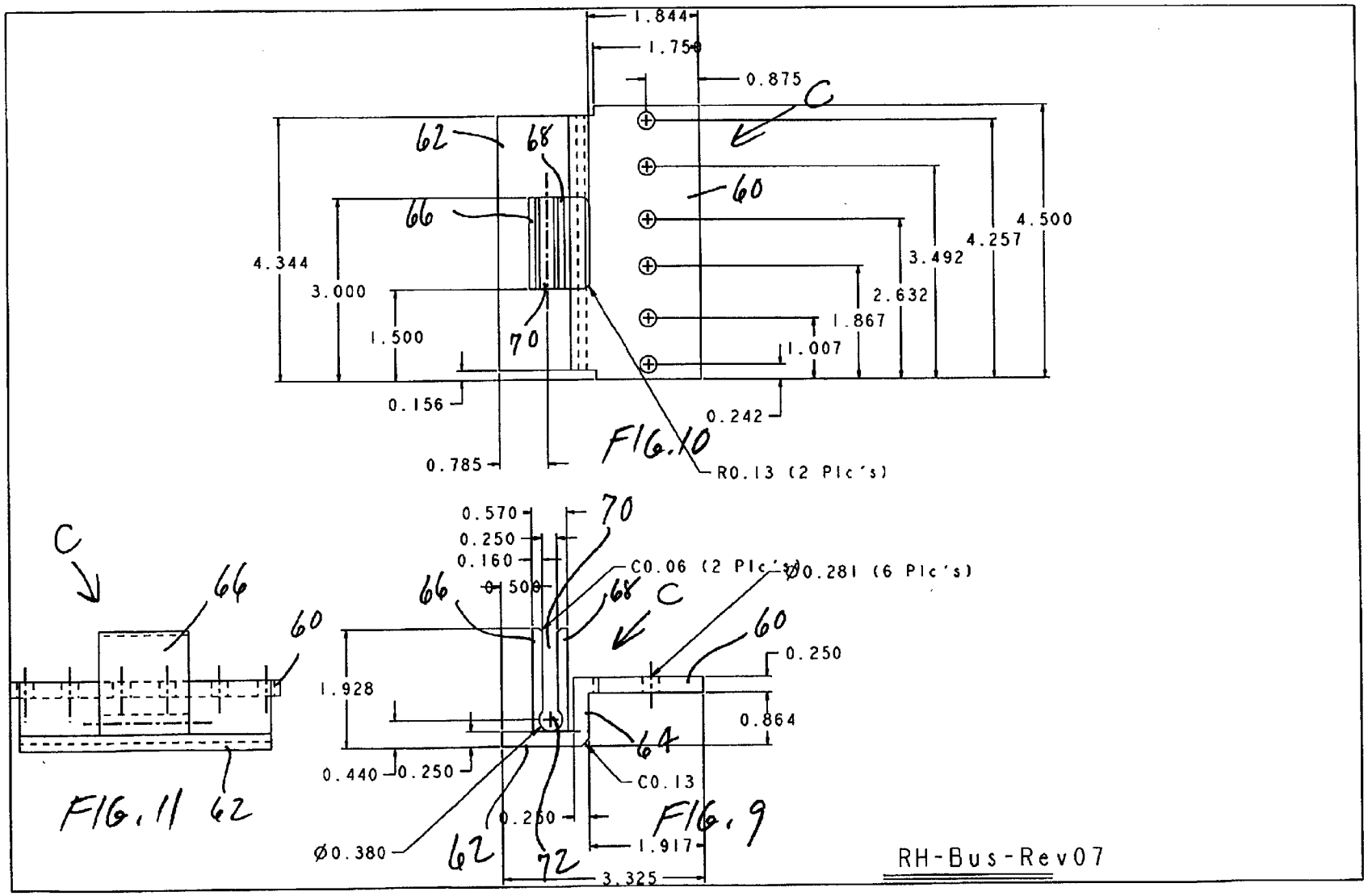
FIG. 9 is a side elevational view of a line or power circuit connector having integral circuit and fuse connector terminals thereon.
FIG. 10 is a top plan view thereof.
FIG. 11 is an end elevational view thereof.

FIGS. 9–11 show a copper bus member or load connector C having a load circuit connector terminal 60 and a fuse connector terminal 62 extending perpendicular from opposite ends of a vertical portion 64. A pair of spaced-apart fuse connector blades extend upwardly from fuse connector terminal 62 to provide a slot 70 therebetween for receiving a fuse terminal. An enlarged opening 72 at the bottom of slot 70 is provided to facilitate resilient bending of blades 66, 68.

FIGS. 12–14 show a copper power or line connector D having a power circuit connector terminal 80 and a shunt terminal 82 extending outwardly from opposite ends of an upright portion 84 perpendicular thereto. A shunt 88 is soldered to the end of shunt terminal 82 and to an end of fuse connector terminal 90 which has a pair of spaced-apart fuse connector blades 94, 96 extending upwardly therefrom to define a slot 98 therebetween for receiving a fuse terminal. An enlarged opening 102 at the bottom of slot 98 is provided to facilitate resilient bending of blades 94, 96. Although various known types of shunts and shunt materials can be used, a shunt defined by a plurality of spaced-apart parallel thin plates of manganin alloy has proven effective.

Shunt takeoff terminals 104, 106 are provided on power circuit connector terminal 80 and fuse connector terminal 90 on opposite sides of shunt 88 for connecting a current measuring device across the shunt by way of a printed circuit board or lead wires.

An integral heat sink 110 in the form of a plurality of spaced-apart parallel plates depends from fuse connector 90 adjacent the shunt 88.

The parts are assembled by moving the parts of FIGS. 9–14 sideways into one of the housing parts through the open side thereof and then moving the open side of the other housing part against the first housing part. For example, the shunt assembly of FIGS. 12–14 may be moved sideways into right hand housing part A1 of FIGS. 5–8 by moving power circuit connector terminal 80 into end wall slot 44*a* while heat sink 110 moves into depression 24*a*. In this position, shunt 88 and shunt terminal 82 will extend along housing bottom wall portion 20 and one side portion of shunt terminal 82 will be received beneath the bottom end of rib 39*a*. A side portion of fuse connector terminal 90 on the opposite side of blades 94, 96 from shunt 88 will be received beneath the bottom ends of ribs 37*a*, 38*a*.

The connector part of FIGS. 9–11 is moved sideways into right hand housing part A1 of FIGS. 5–8 by locating load circuit connector terminal 60 within slot 42*a* in end wall 10*a* while fuse connector portion 62 extends along bottom wall 20*a*. A side portion of fuse connector terminal 62 will be received in the space between the bottom end of rib 36*a* and bottom wall portion 20*a*. The opposite or left hand housing half of FIGS. 1–4 then is moved into cooperative engagement with housing part A1 and the two housing parts are heat staked together along their open sides. This secures the combined fuse holder and shunt within the housing while providing access to the fuse connector blades through opening 18, 18*a*.

Opposite side portions of fuse connector portion 90 will be received between the housing bottom wall and the bottom ends of ribs 37, 37*a*, 38, 38*a*. Opposite side portions of shunt terminal 82 will be received between bottom wall portions 22, 22*a* and the bottom ends of ribs 39, 39*a*. Opposite side portions of fuse connector terminal 62 will be trapped between bottom wall portions 20, 20*a* and the bottom ends of ribs 36, 36*a*.

Load connector part C of FIGS. 9–11 preferably is cast on one-piece of copper. The line connector part D of FIGS. 12–14 is of three pieces that are soldered together to form a one-piece assembly. Fuse connector terminal 90 and blades 94, 96 preferably are cast in one-piece of copper. The plates of the heat sink 110 are spaced-apart in a direction between the housing sidewalls 14, 14*a*.

FIG. 15 shows a prior art fuse and fuse holder assembly F having a fuse holder 130 and a fuse 132. Fuse holder 130 has externally threaded posts 134, 136 that extend through holes 138, 140 in fuse terminals 142, 144. Washers 150, 151 and 152, 153 are received on posts 134, 136, and nuts 154, 156 thread on posts 134, 136 to removably secure fuse 132 to fuse holder 130. Blades 160, 162 that are in conductive relationship with fuse terminals 142, 144 are receivable in slots 70, 98 on connectors C, D of FIGS. 9 and 12. As seen in FIG. 16, fuse holder 130 has a handle 170 hingedly connected to handle attachments 172, 174.

Left and right hand housing parts A and A1 define a two part housing. Each part has opposite end walls, a bottom wall, one sidewall and an opposite open side opposite from the one sidewall. The two housing parts are essentially mirror images of one another, and are butted together along their open sides and heat staked together with the connectors of FIGS. 9–14 trapped therein.

Each housing part has a partial top wall intersecting the one sidewall and the end walls. A plurality of vertical ribs integral with the one sidewall and the partial top wall are spaced-apart in a direction between the end walls. The ribs have rib bottom ends spaced above the housing bottom wall. The fuse connectors extend along the housing bottom wall adjacent the end walls, with opposite side portions thereof received between the rib bottom ends and the housing bottom wall.

A depression in the housing bottom wall receives a heat sink that depends from the fuse connector that is integral with the shunt.

Slots extend into the housing end walls from the open sides thereof toward the one sidewall parallel to the housing bottom wall for receiving flat plate connectors that connect to a bus of a power source or a load.

An instrument or monitoring circuit is connected across shunt 88 to register the voltage drop thereacross and thereby measure the current passing through the combined fuse holder and shunt to the load.

Figure 15A:
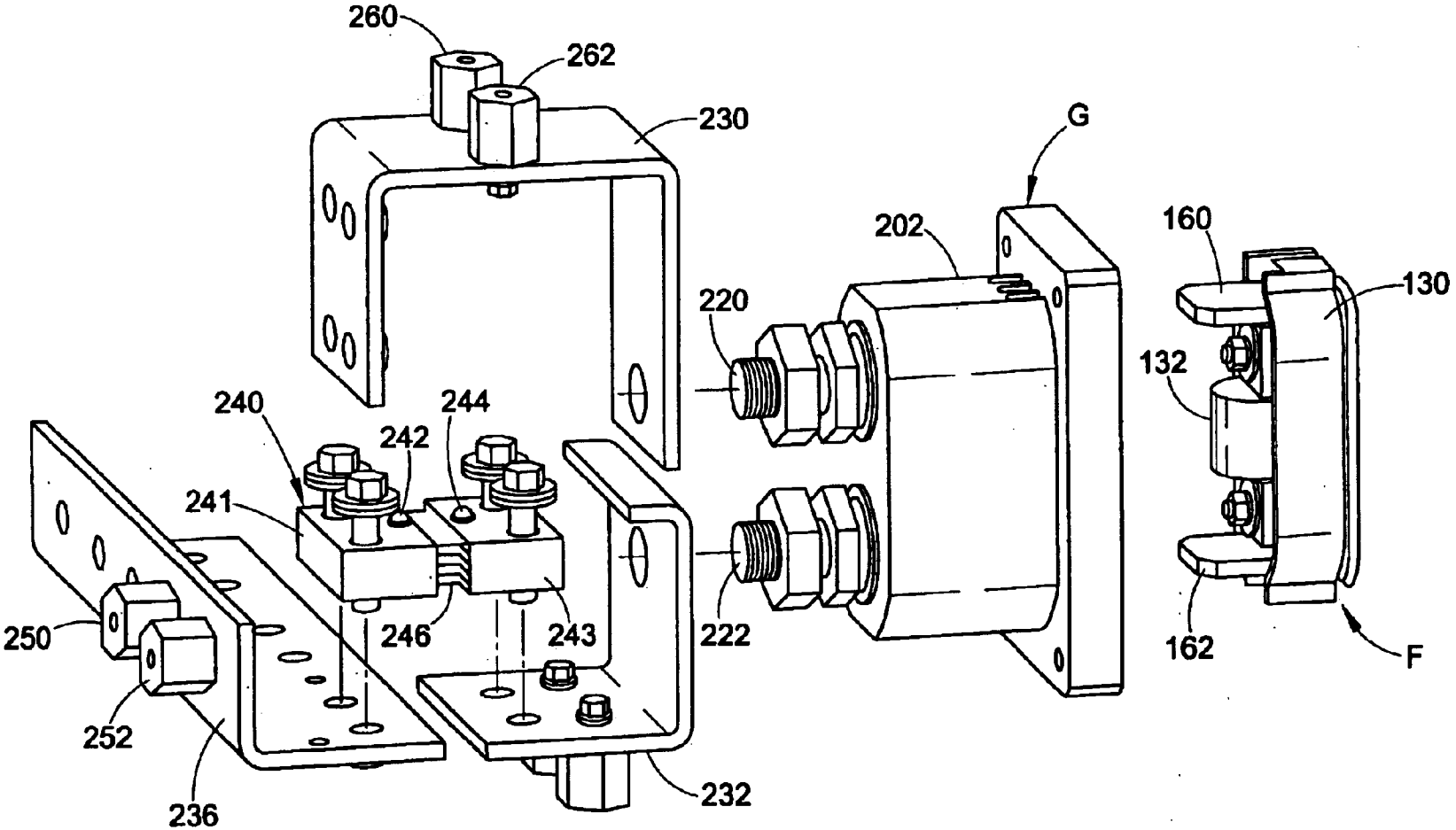
FIG. 15A (PRIOR ART)
FIG. 15A is a perspective illustration of a prior art device.
Figure 15B:
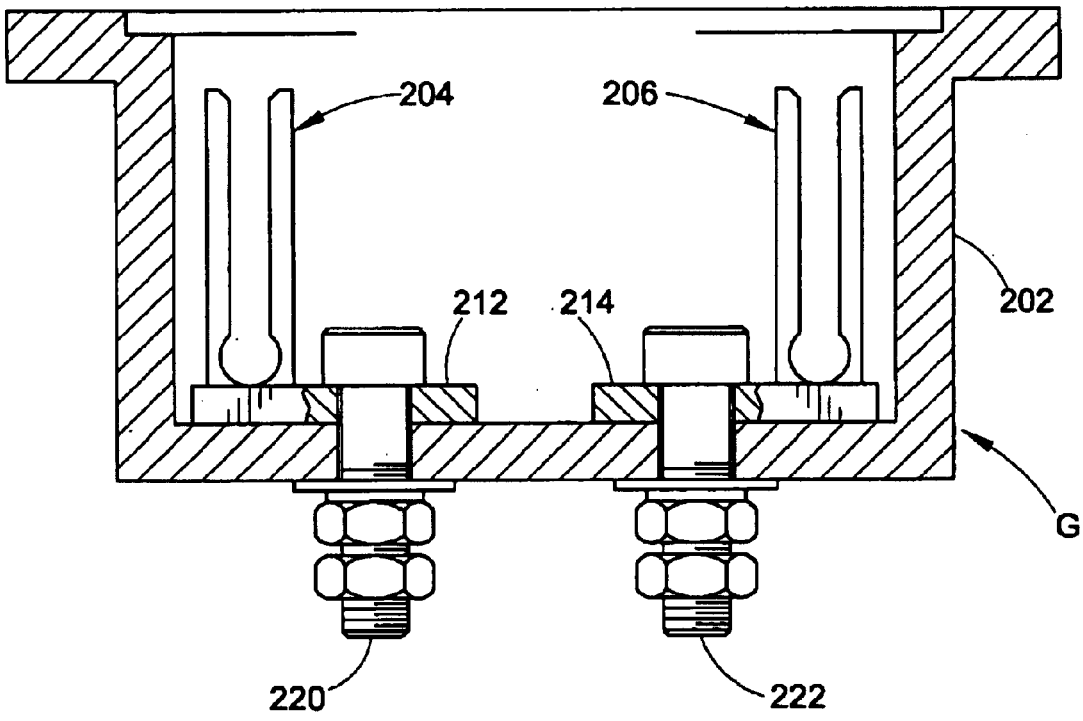
FIG. 15B (PRIOR ART)
FIG. 15B is a cross-sectional elevational view of the fuse receptacle of FIG. 15A.
Figure 16:
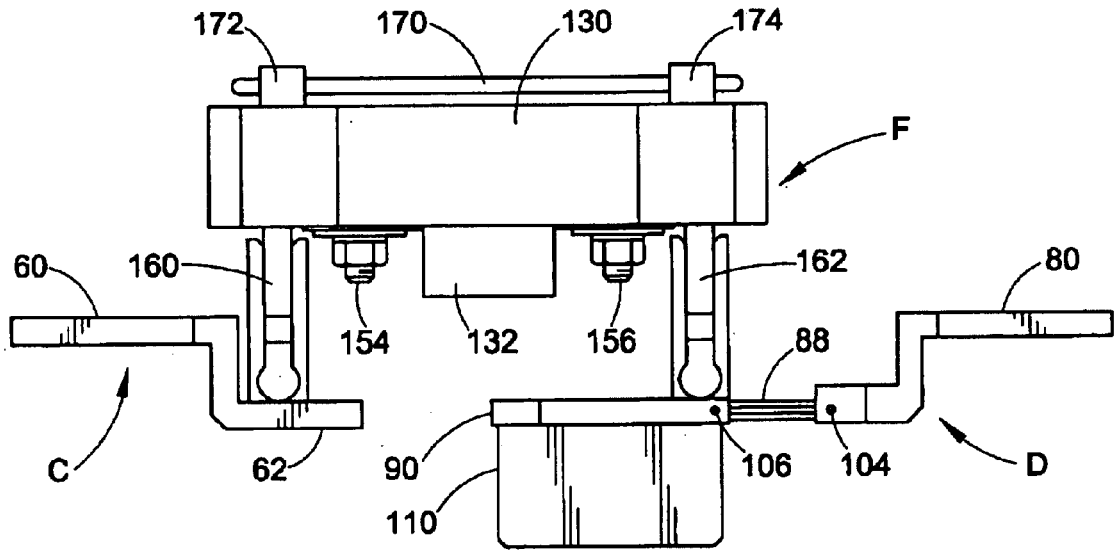
FIG. 16 is a side elevational view showing the fuse and fuse holder assembly of FIG. 15 combined with the connectors of FIGS. 9 and 12 of the present application.
Figure 17:
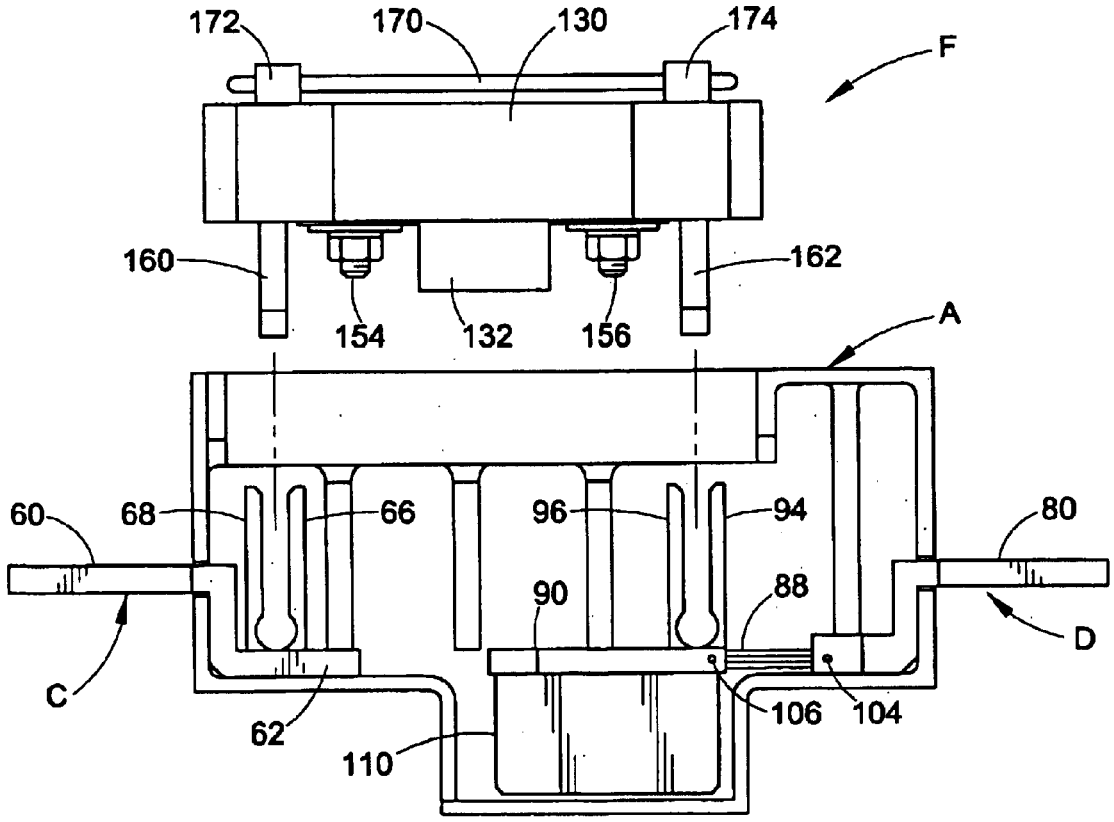
FIG. 17 is a side elevational view showing the connectors of FIGS. 9 and 12 within the housing half of FIG. 5, and with the blades on the fuse holder and fuse assembly of FIG. 15 positioned for insertion into the clips on the connectors.

FIG. 15A shows a prior art arrangement in which the fuse holder F is receivable in a fuse receptacle G that is shown in section in FIG. 15B. The fuse receptacle G has a plastic housing 202 with clips 204, 206 that receive fuse holder blades 160, 162 to connect fuse 132 across clips 204, 206. Clips 204, 206 are attached to plates 212, 214 that are secured within the bottom of housing 202 by circuit connector studs 220, 222 that extend through suitable holes in the bottom of housing 202. Referring back to FIG. 15A, circuit connector stud 220 attaches to load copper bar 230, and circuit connector stud 222 attaches to shunt copper bar 232. Line copper bar 236 is connected with shunt copper bar 232 by way of shunt assembly 240 and suitable bolt and nut assemblies. Terminals 242, 244 are provided on shunt assembly 240 on shunt blocks 241, 243 on opposite sides of shunt 246 for attaching a current measuring device across the shunt. Line wires are connected to line copper bar 236 by a busbar or by lugs 250, 252. A complete circuit is established from line copper bar 236 to shunt assembly 240, to shunt copper bar 232, to stud 222, through fuse 132, to stud 220 and to load copper bar 230. Load wires are connected with load copper bar 230 by a busbar or by suitable lugs 260, 262.

Although the invention has been shown and described with reference to a preferred embodiment, it is obvious that equivalent alterations and modifications will occur to others skilled in the art upon the reading and understanding of this specification. The present invention includes all such equivalent alterations and modifications and is limited only by the scope of the claims.

We claim:

1. A combined fuse holder and current monitor comprising:

a two part housing, each housing part having opposite end walls, a bottom, one sidewall and an open side opposite from said one sidewall;

each end wall having a slot therein extending from said open side toward said one sidewall parallel to said bottom;

each sidewall having a plurality of vertical ribs thereon spaced-apart in a direction between said end walls;

said ribs having rib bottom ends spaced above said bottom;

said housing parts being secured together with said open sides thereof butted together;

a first connector having a first circuit connector terminal extending through said slot in one of said end walls and having a first fuse connector terminal within said housing, opposite side portions of said first fuse connector terminal being received between certain of said rib bottom ends and said housing bottom, said first fuse connector terminal having a first fuse connector extending upwardly therefrom between said sidewalls;

a second connector having a second circuit connector terminal extending through said slot in the other of said housing end walls and having a second fuse connector terminal within said housing, opposite side portions of said second fuse connector being received between certain other of said rib bottom ends and said housing bottom, said second fuse connector terminal having a second fuse connector extending upwardly therefrom between said sidewalls; and a current monitoring device connected between said second circuit connector terminal and said second fuse connector terminal within said housing.

2. The combined fuse holder and shunt of claim 1 wherein said current monitoring device comprises a shunt.

3. The combined fuse holder and current monitor of claim 2 wherein said shunt is soldered between said second circuit connector terminal and said second fuse connector terminal.

4. The combined fuse holder and current monitor of claim 1 including a depression in said housing bottom, said second fuse connector terminal having a heat sink depending therefrom and extending into said depression.

5. The combined fuse holder and current monitor of claim 1 wherein each housing part has a partial top wall intersecting said sidewall and said ribs are integral with said top wall.

6. The combined fuse holder and current monitor of claim 1 wherein said current monitoring device comprises a shunt.

7. The combined fuse holder and current monitor of claim 1 wherein said current monitoring device comprises a shunt having a plurality of vertically-spaced parallel plates of manganin that extend parallel to said housing bottom.

8. A combined fuse holder and current monitor having a pair of circuit connectors, a pair of fuse connectors connected between said pair of circuit connectors, a current monitoring device connected between one of said fuse connectors and one of said circuit connectors, a two piece housing in which said fuse holder and current monitor are received, and each piece of said two piece housing having opposite end walls with slots therein through which said circuit connectors project.

9. A combined fuse holder and current monitor having a pair of circuit connectors, a pair of fuse connectors connected between said pair of circuit connectors, a current monitoring device connected between one of said fuse connectors and one of said circuit connectors, a two piece housing in which said fuse holder and current monitor are received, said housing including a bottom wall having a depression therein, said one of said fuse connectors to which said current monitor is connected having a heat sink thereon, and said heat sink being received in said depression.

10. The fuse holder of claim 9 wherein said depression has a slotted bottom wall.

11. A combined fuse holder and current monitor having a pair of circuit connectors, a pair of fuse connectors connected between said pair of circuit connectors, a current monitoring device connected between one of said fuse connectors and one of said circuit connectors, a two piece housing in which said fuse holder and current monitor are received, said housing including opposite sidewalls and a bottom wall, a plurality of spaced apart ribs on said sidewalls, said ribs having rib ends spaced above said bottom wall, and portions of said combined fuse holder and current monitor being received between said rib ends and said bottom wall.

12. The fuse holder and current monitor of claim 11 wherein said housing includes opposite end walls having end wall slots therein and said circuit connectors project through said end wall slots.

13. A combined circuit and fuse connector comprising: a circuit connector terminal and a fuse connector terminal extending outwardly in opposite directions from opposite ends of a vertical portion generally perpendicular thereto, said fuse connector terminal having a slot opening outwardly generally perpendicular thereto for receiving a fuse terminal, a current monitoring device interposed between said circuit connector terminal and said fuse connector terminal and forming the sole connection therebetween, and said current monitoring device being interposed between said fuse connector terminal and said vertical portion.

* * * * *